US006247947B1

(12) United States Patent
Knoernschild et al.

(10) Patent No.: US 6,247,947 B1
(45) Date of Patent: Jun. 19, 2001

(54) MEMORY CARD CONNECTOR

(75) Inventors: Steven Knoernschild; Stephen Yoder; Hesham Elkhatib, all of Memphis, TN (US)

(73) Assignee: Thomas & Betts International, Inc., Sparks, NV (US)

( * ) Notice: Subject to any disclaimer, the term of this patent is extended or adjusted under 35 U.S.C. 154(b) by 0 days.

(21) Appl. No.: 09/506,910

(22) Filed: Feb. 18, 2000

(51) Int. Cl.[7] ..... H01R 13/62
(52) U.S. Cl. ..... 439/159
(58) Field of Search ..... 439/159, 152–160

(56) References Cited

U.S. PATENT DOCUMENTS 4,694,380 * 9/1987 Mallory et al. ..... 439/160
5,466,166 * 11/1995 Law et al. ..... 439/159
5,871,365 * 2/1999 Kajiura ..... 439/159

* cited by examiner

*Primary Examiner*—Neil Abrams
(74) *Attorney, Agent, or Firm*—Hoffman & Baron, LLP

(57) ABSTRACT

A connector for securing a memory card within an electronics device such as a PDA, digital camera, cell phone, or downloadable Internet music player. The connector includes a housing and a receptacle formed in the housing for receiving at least partially the memory card therein. Further included in the housing is an ejector mechanism for ejecting the memory card at least partially from the receptacle, which comprises an actuator rod that is preferably integrally formed with the housing and a lever arm that is also preferably integrally formed with the housing.

11 Claims, 6 Drawing Sheets

MEMORY CARD CONNECTOR

FIELD OF THE INVENTION

In general, the present invention relates to connectors and, in particular, the present invention relates to a memory card connector for use in portable electronic devices.

BACKGROUND

The popularity of the Internet among consumers over the last few years has resulted in it becoming a storage place for such digital media as audio and video recordings. Current web locations allowing such digital media to be downloaded from the Internet include: MP3.com, Liquidaudio.com, Launch.com, and Realnetworks.com. This digital media is now downloadable to portable electronic devices that contain a memory card, such as a flash memory card, for storing the digital media.

Connectors for coupling the memory cards to a PCB in the portable device are required by industry and consumers to have an ejector mechanism built-in for removing the memory cards upon actuation of a push button. Currently, such connectors have complex ejector mechanisms, requiring numerous individual parts, which greatly increases installation time and costs.

SUMMARY OF THE INVENTION

The present invention eliminates the above difficulties and disadvantages by providing a memory card connector that includes an ejector having an actuator rod and lever arm that are preferably integrally formed to a housing, thereby greatly reducing the installation time and cost of the memory card connector. This integral coupling is preferably accomplished by flexible actuator and lever webs but can also be performed at least in part by an actuator band integrally formed between the housing and actuator rod. In another embodiment the actuator rod is a separate part and the lever arm is integrally molded into the housing. In still another embodiment the lever arm is pivotally mounted on the housing and the actuator arm is integrally formed within the housing.

A push button is formed on one end of the actuator rod and a plurality of actuator coupling members are formed on the housing for snap fitting the actuator rod thereto if needed and that allow the actuator rod to slide therein.

DETAILED DESCRIPTION OF THE PREFERRED EMBODIMENT(S)

Figure 1:
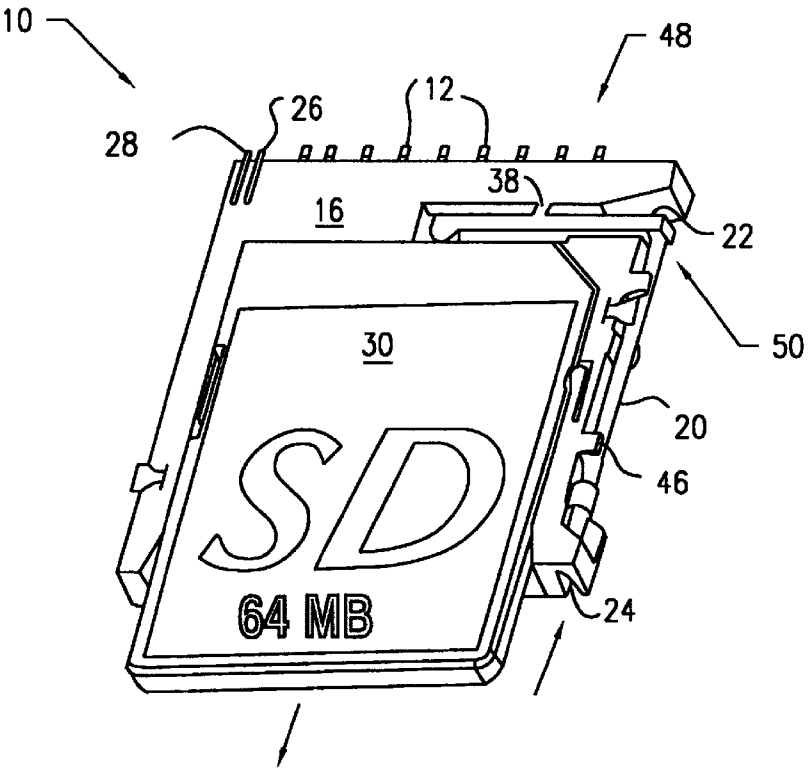
FIG. 1 is a perspective view of a connector and memory card of the present invention.
Figure 3:
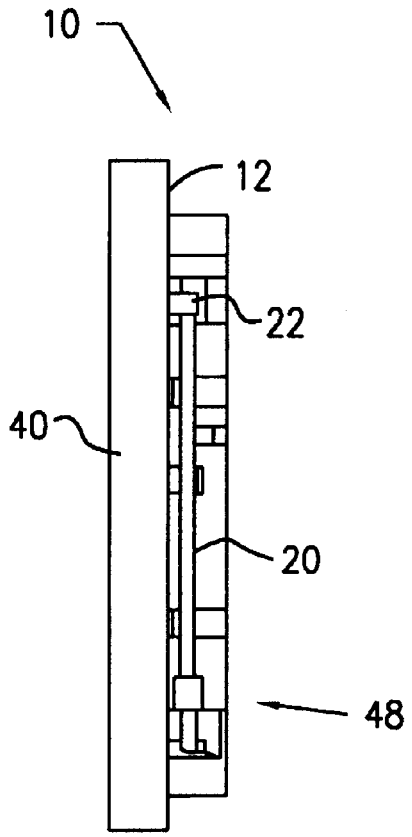
FIG. 3 is a side elevational view of the connector of the present invention mounted on a printed circuit board.
Figure 4:
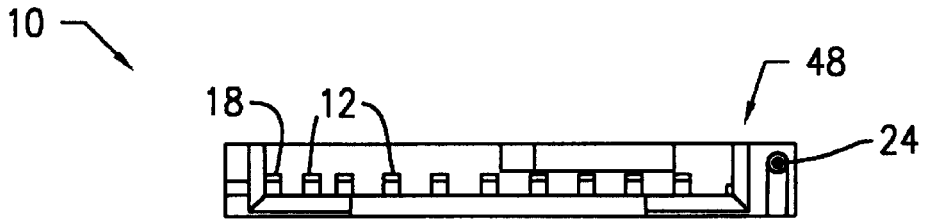
FIG. 4 is another side elevational view of the connector of the present invention.

The above and other features, aspects, and advantages of the present invention will now be discussed in the following detailed description and appended claims, which are to be considered in conjunction with the accompanying drawings and in which identical reference characters designate like elements throughout the views. Shown in FIG. 1 is a memory card 30 disposed in a housing 48 of a connector 10 of the present invention. The connector 10 is typically disposed in a consumer electronic device such as a PDA, digital camera, cell phone, or Internet music player. The memory card 30 shown is a Secure Digital card manufactured by SanDisk of San Jose, Calif., and is shown having a flash memory capacity of 64 megabytes. The memory card 30 can, however, can be of any capacity and store any type of digital media such as audio data (which is preferably stored in the MP3data compression format) and video data (which is preferably stored in the MPEG4 data compression format). It is also understood that the memory card 30 can be a Multi Media Card, which is also manufactured by SanDisk of San Jose, Calif. or any other media card.

Figure 2:
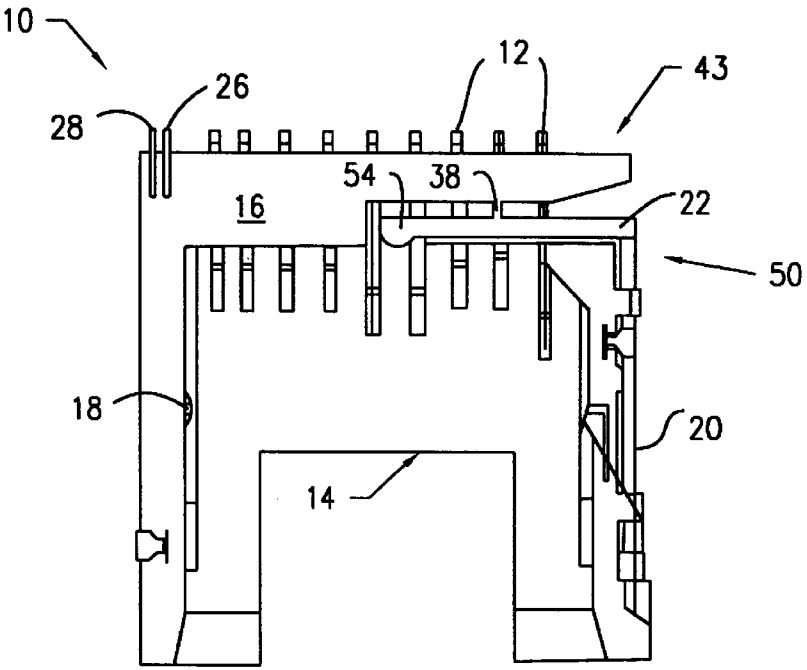
FIG. 2 is a front plan view of the connector of the present invention.
Figure 6:
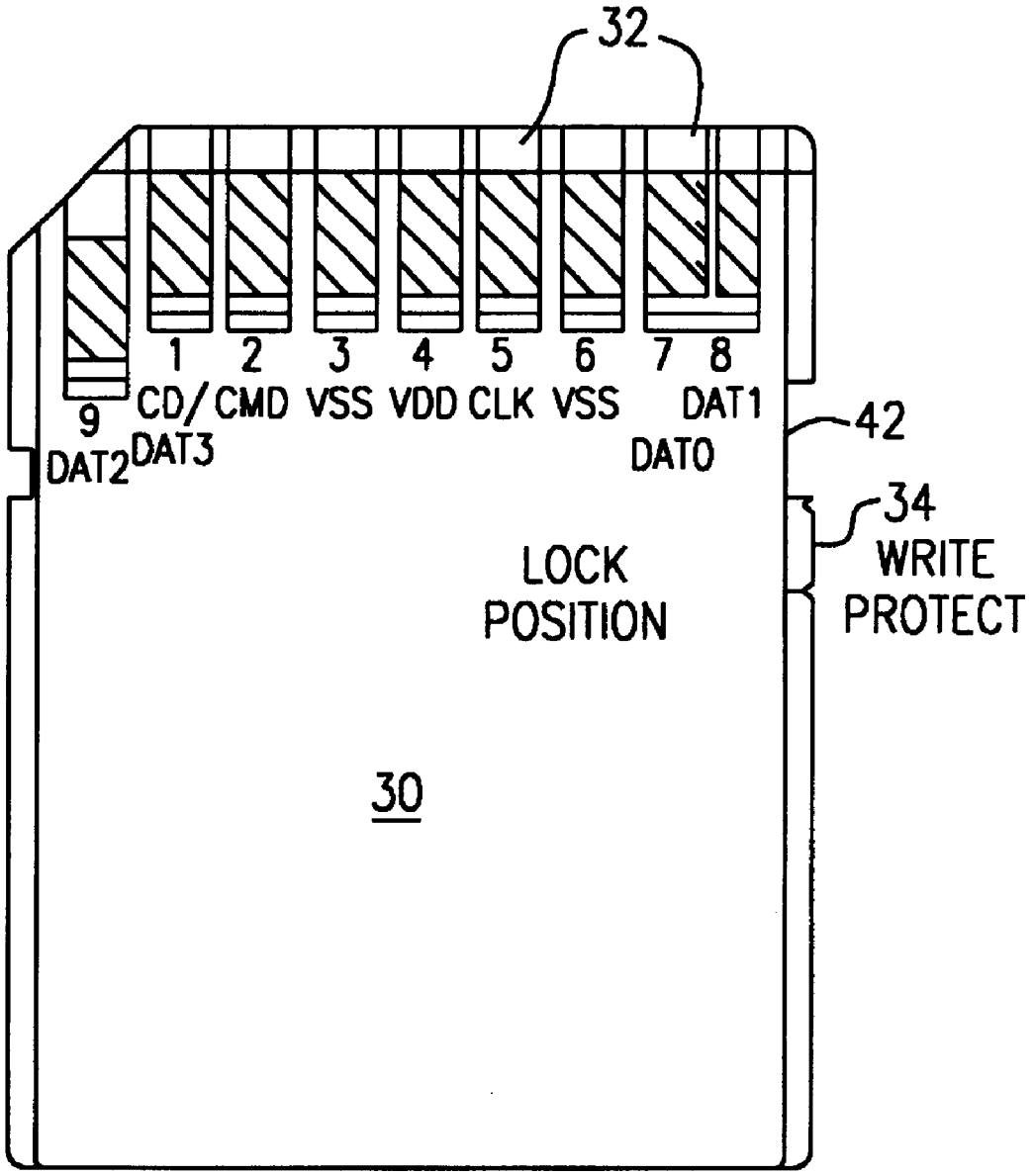
FIG. 6 is a plan view of the memory card of the present invention.

Shown in FIGS. 1–4, are a plurality of electrical contacts 12 that are coupled to the housing 48 and preferably soldered to the PCB 40. A plurality of connector ports 32 are disposed in the memory card 30, as shown in FIG. 6, for communicating with the PCB 40, via the plurality of electrical contacts 12, once the memory card 30 is installed in the housing 48. The housing 48 can be mounted on the PCB 40 such that the PCB 40 rests below the housing 48 or above such that it is biased against the resting surface 16, which is shown in FIG. 2. The housing 48 is preferably formed of a non-conductive thermo-formed plastic.

Figure 5:
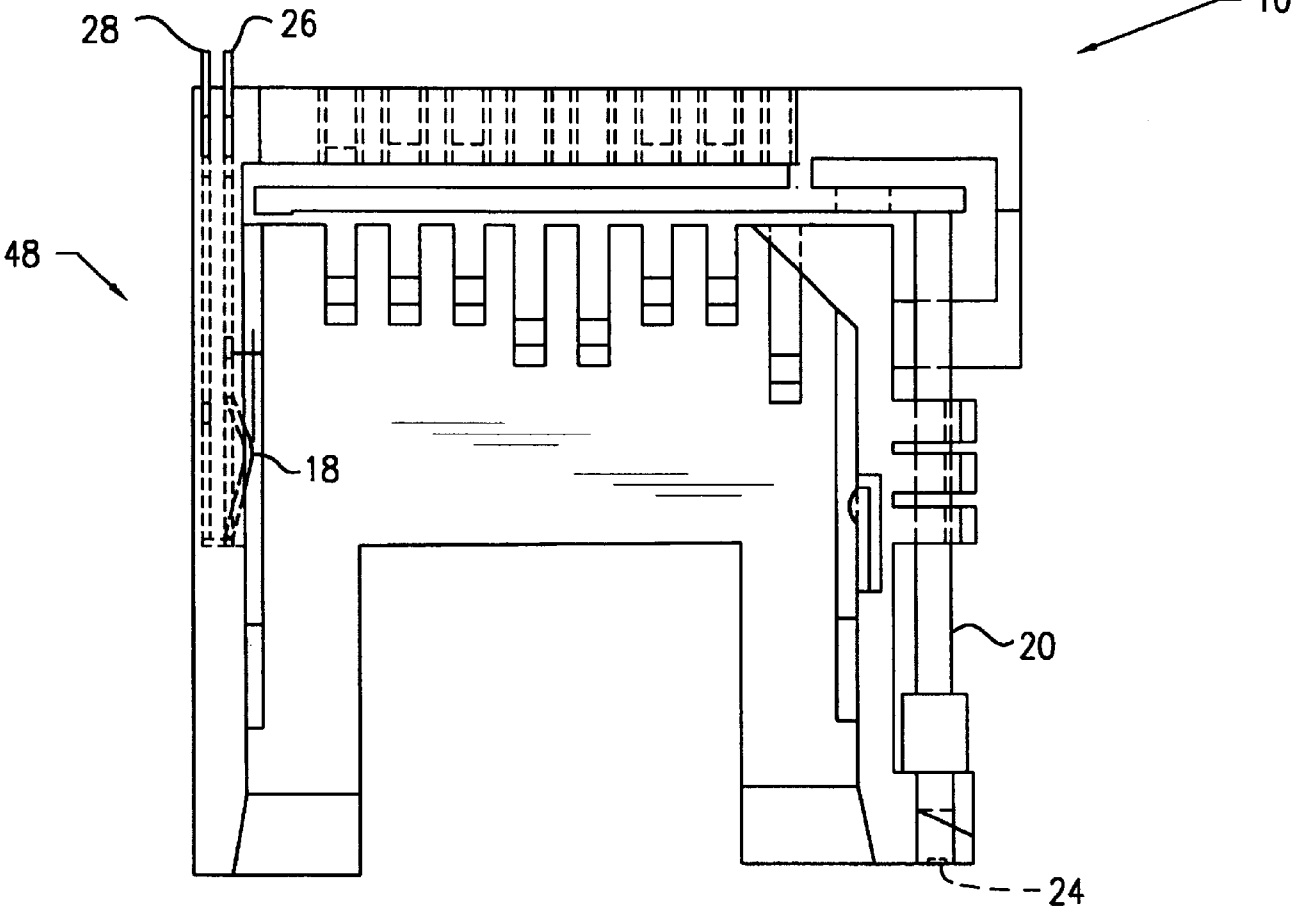
FIG. 5 is a rear plan view of the connector of the present invention.

A receptacle 14, as shown in FIG. 2, is contained in the housing 48 and functions to receive the memory card 30 at least partially therein. As is further shown in FIG. 6, a notch 42 is contained on one side of the memory card 30 wherein a write protect switch 34 is contained and slidable between two positions along the notch 42. When the write protect switch 34 is in the locked position, as shown, data cannot be copied from the memory card 30. As shown in FIGS. 2 and 5, an angled cam 18 is disposed in the housing 48 and is preferably integrally formed with a first indication contact 26, which extends parallel to a second indication contact 28 that is also contained in the housing 48. Both the first indication contact 26 and the second indication contact 28 are soldered to the PCB 40 at one end. At the other end, the first indication contact 26 and the second indication contact 28 are spaced apart in the normal position as shown. When the memory card 30 is inserted into the housing 48 and the write protect switch 34 is in the locked position, the cam 18 is biased toward the second indication contact 28 such that the cam 18 contacts the second indication contact 28. This completes a circuit on the PCB 40 such that the device determines that the write protect switch 34 is in the locked position and data cannot be copied from the memory card 30. If, however, the write protect switch 34 is not in the locked position, the cam 18 will extend into the notch 42 and there will be no contact between the first indication contact 26 and the second indication contact 28.

Figure 7:
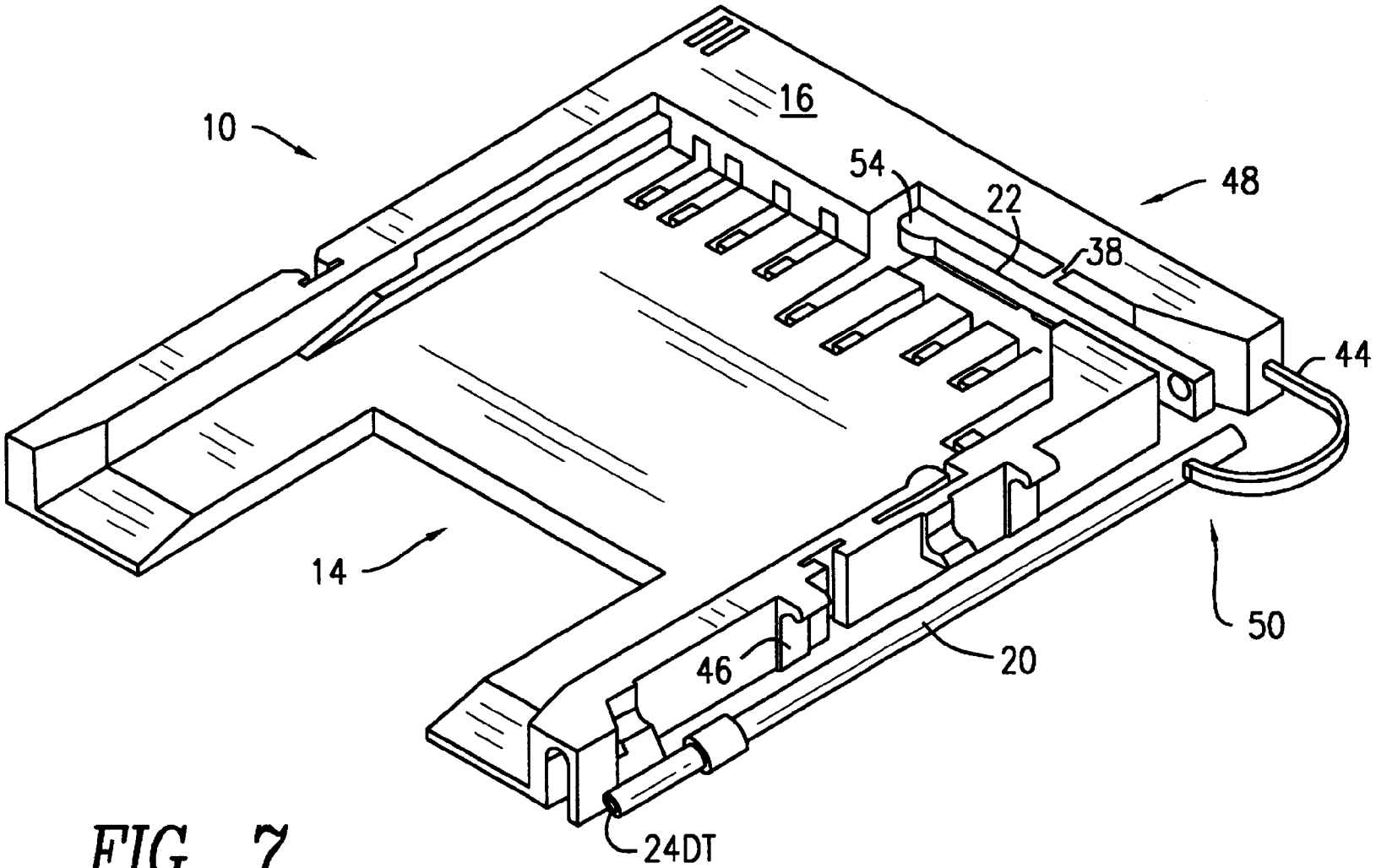
FIG. 7 is a perspective view of the connector and memory card of the present invention with both an actuator rod and a lever arm integrally formed within a housing of the connector.
Figure 8:
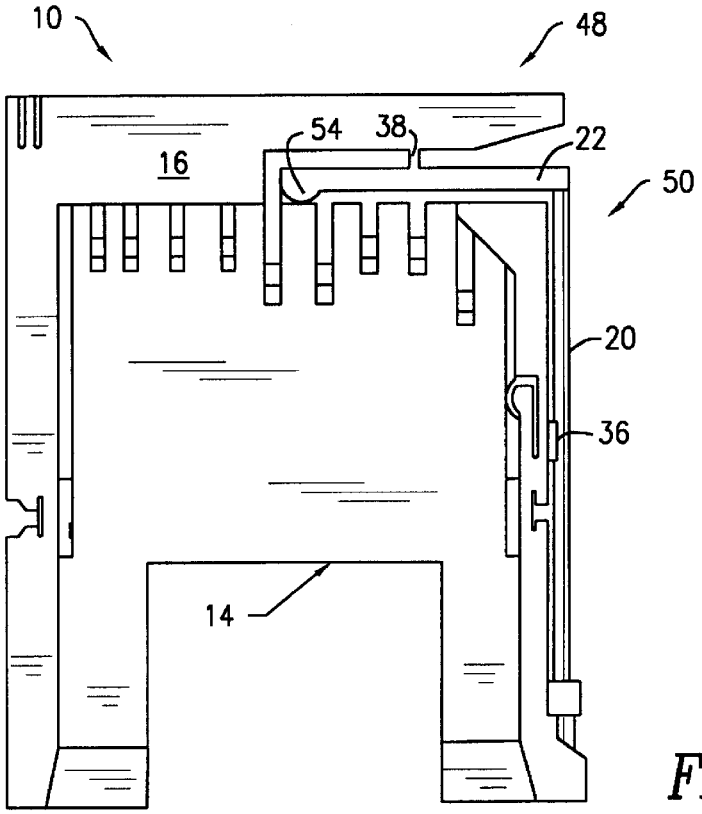
FIG. 8 is a plan view of the connector of the present invention showing both the actuator rod and the lever arm integrally formed with the housing and the actuator rod integrally formed to the lever arm.

Referring now with particularity to FIGS. 1–5, and 7–9, an ejector mechanism 50 is shown for ejecting the memory card 30 from the housing 48. The ejector mechanism 50 includes an actuator rod 20 that has a first end formed into a push button 24. At the second end, the actuator rod 20 preferably abuts a lever arm 22, which is disposed perpendicular to the actuator rod 20. It is understood, however, that the second end of the actuator rod 20 can be integrally formed with the lever arm 22 as shown in FIG. 8, for ejecting the memory card 30, as will be discussed below. What's more, on the second end of the lever arm 22 is formed a barb 54 for contacting the memory card 30 upon ejection. In the embodiment shown in FIGS. 1–4, the actuator rod 20 is coupled to the housing 48 via snap fit into the plurality of actuator coupling members 46 as shown in FIGS. 1–5, 7 and 9. The actuator coupling members 46 are formed on the housing 48 for holding the actuator rod 20 via snap fit and for allowing it to slide therein when the push button 24 is actuated.

In the preferred embodiment, which is shown in FIG. 8, both the actuator rod 20 and lever arm 22 are integrally formed with the housing 48. The lever arm 22 is coupled to the housing 48 via a flexible lever web 38 which is also constructed of a bendable thermo-formed plastic. Moreover, the actuator rod 20 is integrally formed with the housing 48 via a actuator web 36, which is also constructed of a bendable thermo-formed plastic and is similar to the lever web 38. As shown, the second end of the actuator rod 20 is integrally formed with the lever arm 22. In operation, when the push button 24 is depressed, typically by a refined instrument such as a pen or stylus from a PDA device, the actuator rod 20 is biased inward against the first end of the lever arm 22 and the actuator web 36 is bent or flexed. The second end of the lever arm 22, wherein the barb 54 is formed, is then cantilevered against the memory card 30, thereby pushing the memory card 30 outward, away from the receptacle 14 and the housing 48. In this embodiment the lever arm 22 is integrally formed with housing 48 via the lever web 38, which bends or is flexed when cantilevered by the actuator rod 20.

In another embodiment, which is shown in FIG. 7, both the actuator rod 20 and lever arm 22 are integrally formed with the housing 48 again, but the actuator rod 20 must be snap fit into the housing 48 for operation or simply be slidingly retained via actuator coupling members 46. In particular, the actuator rod 20 must be snap fit or slid into the actuator coupling members 46 of the housing 48 prior to installation of the connector 10 in the electronics device. Again in this embodiment the lever arm 22 is coupled to the housing 48 via a flexible lever web 38, which is also constructed of a bendable thermo-formed plastic. Moreover, the actuator rod 20 is integrally formed with the housing 48 via an actuator band 44, which is also constructed of a bendable thermo-formed plastic. The actuator band 44 is coupled between the resting surface 16 and the second end of the actuator rod 20. In operation, when the push button 24 is depressed, typically by a refined instrument such as a pen or stylus, the actuator rod 20 is biased inward against the first end of the lever arm 22. The second end of the lever arm 22, wherein the barb 54 is formed, is then cantilevered against the memory card 30, thereby pushing the memory card 30 outward, away from the receptacle 14 in the housing 48. In this embodiment the lever arm 22 is integrally formed with housing 48 via the lever web 38, which bends or is flexed when cantilevered by the actuator rod 20.

Figure 9:
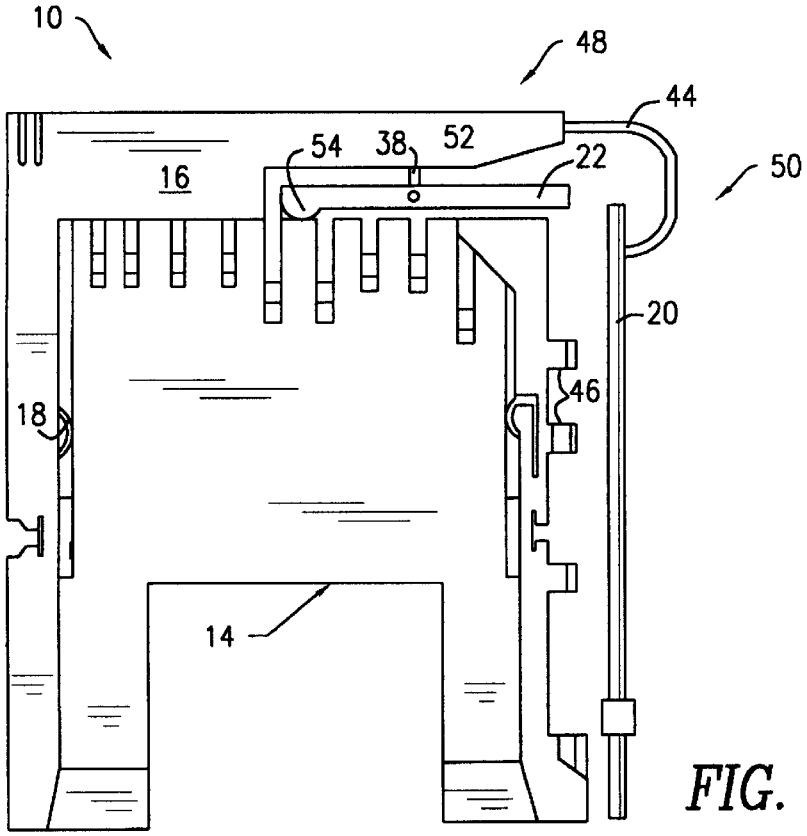
FIG. 9 is a plan view of the connector of the present invention showing the lever arm pivotally secured to the housing.

In still another embodiment, which is shown in FIG. 9, the actuator rod 20 is integrally formed with the housing 48 as described above in the second embodiment of FIG. 7. The lever arm 22, however, is not integrally formed with the housing 48, but is coupled to the housing 48 by a pivot pin 52. Thus, the lever arm 22 must be coupled to the housing 48 prior to installation of the connector 10 in the electronics device. Specifically, the lever arm 22 is coupled to the housing 48 via the pivot pin 52 being inserted at least partially through the flexible lever web 38 which is also constructed of a bendable thermo-formed plastic. Again, the actuator rod 20 is integrally formed with the housing 48 via an actuator band 44, which is also constructed of a bendable thermo-formed plastic and must be snap fit or inserted into place in the actuating coupling members 46 of the housing 48 before operation. In operation, when the push button 24 is depressed, typically by a refined instrument such as a pen or stylus, the actuator rod 20 is biased inward against the first end of the lever arm 22. The second end of the lever arm 22, wherein the barb 54 is formed, is then cantilevered against the memory card 30, thereby pushing the memory card 30 outward, away from the receptacle 14 in the housing 48. In this embodiment the lever arm 22 pivots about the pivot pin 52 when cantilevered by the actuator rod 20.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

What is claimed is:

1. A connector for securing a memory card within an electronics device, the connector comprising:

a housing;

a receptacle formed in the housing for receiving at least partially the memory card therein; and an ejector mechanism for ejecting the memory card at least partially from the receptacle and including:

an actuator rod integrally formed with the housing; and a lever arm integrally formed with the housing.

2. The connector for securing a memory card within an electronics device of claim 1 further comprising a push button integrally formed on the actuator rod.

3. The connector for securing a memory card within an electronics device of claim 1 wherein the actuator rod is integrally formed to the lever arm.

4. The connector for securing a memory card within an electronics device of claim 1 wherein the actuator rod is disposed perpendicular to the lever arm within the housing when the memory card is received at least partially within the receptacle.

5. The connector for securing a memory card within an electronics device of claim 1 further comprising an actuator web to which the actuator rod is integrally formed within the housing.

6. The connector for securing a memory card within an electronics device of claim 5 wherein the actuator web is flexible such that it bends when the actuator rod is biased.

7. The connector for securing a memory card within an electronics device of claim 1 further comprising a lever web to which the lever arm is integrally formed within the housing.

8. The connector for securing a memory card within an electronics device of claim 7 wherein the lever web is flexible such that it bends when the actuator rod is biased against the lever arm.

9. The connector for securing a memory card within an electronics device of claim 1 further comprising an actuator band to which the actuator rod is integrally formed within the housing.

10. The connector for securing a memory card within an electronics device of claim 9 wherein the actuator band is flexible such that it bends when the actuator rod is biased.

11. The connector for securing a memory card within an electronics device of claim 9 wherein the actuator rod is also snap fit into the housing for operation.

* * * * *